United States Patent [19]

Gravina

[11] Patent Number: 5,005,753

[45] Date of Patent: Apr. 9, 1991

[54] CARTRIDGE FOR A RIVETING GUN

[75] Inventor: Edoardo Gravina, Cadriano di Granarolo Emilia, Italy

[73] Assignee: Fasco S.p.A., Cadriano di Granarolo Emilia, Italy

[21] Appl. No.: 459,225

[22] Filed: Dec. 29, 1989

[30] Foreign Application Priority Data

Jan. 18, 1989 [IT] Italy ..... 4713/89[U]

[51] Int. Cl.[5] ..... B27F 7/08

[52] U.S. Cl. ..... 227/120; 227/127

[58] Field of Search ..... 227/120, 127

[56] References Cited

U.S. PATENT DOCUMENTS 2,819,466 1/1958 Campbell et al. ..... 227/127
3,056,137 10/1962 Wandel et al. ..... 227/127
3,058,114 10/1962 Haubold ..... 227/127
3,491,931 1/1970 Sales ..... 227/127
3,734,379 5/1973 Powers ..... 227/127

FOREIGN PATENT DOCUMENTS 1188009 2/1965 Fed. Rep. of Germany ..... 227/120

*Primary Examiner*—Timothy V. Eley
*Attorney, Agent, or Firm*—Guido Modiano; Albert Josif

[57] ABSTRACT

This cartridge for riveting guns comprises an elongated body in the shape of an inverted U which forms a channel for accommodating and guiding the fastener elements and a slidable lid closing the accommodating channel. The lid has a beak which defines the expulsion channel of the fastener elements. Proximate to the end of the elongated body which is opposite to the expulsion channel the cartridge defines a lateral seat for retaining an elastic body defining an abutment for a protrusion of the sliding lid, proximate to the beak.

3 Claims, 1 Drawing Sheet

CARTRIDGE FOR A RIVETING GUN

BACKGROUND OF THE INVENTION

The present invention relates to a cartridge for a riveting gun.

As is known, in riveting guns the fastener elements (nails or staples) are accommodated in a cartridge comprising an elongated body substantially in the shape of an inverted U which is connected with one of its ends to the expulsion channel of the fastener elements and is fixed with its other end to the handgrip by means of a coupling element.

Said U-shaped body defines the accommodation and guiding channel for the staples or nails and can be closed by means of a slidable lid which is guided in longitudinal recesses defined in the opposites walls of the channel.

The lid is provided, at one end, with a beak which in the closed position of the accommodation channel of the staples or nails, closes the end portion of the expulsion channel.

Said beak is adapted to abut against an adapted arrester U-bolt rigidly associated with the body of the cartridge when the lid is extracted in open position to allow the insertion of a strip of fastener elements into the guiding channel.

It has been observed that due to the rough treamtment conditions to which riveting guns are subjected by the users, the abutment of the beak on the arrester U-bolt unavoidably produces permanent deformations or even breakages of said U-bolt, with the negative consequences which derive therefrom for the efficiency of the riveting gun.

SUMMARY OF THE INVENTION

The technical aim of the present invention is therefore to provide an improvement which obviates the above described disadvantages of known tools.

Within the scope of this aim, an object of the invention is to provide an improvement which is structurally simple and is therefore such as to not compromise the economy of the tool.

This aim and this object are achieved by a cartridge for riveting guns, as defined in the appended claims.

BRIEF DESCRIPTION OF THE DRAWINGS

The characteristics and advantages of the invention will become apparent from the following detailed description of a preferred embodiment, illustrated only by way of non-limitative example in the accompanying drawings, wherein.

DESCRIPTION OF THE PREFERRED EMBODIMENTS

Figure 1:
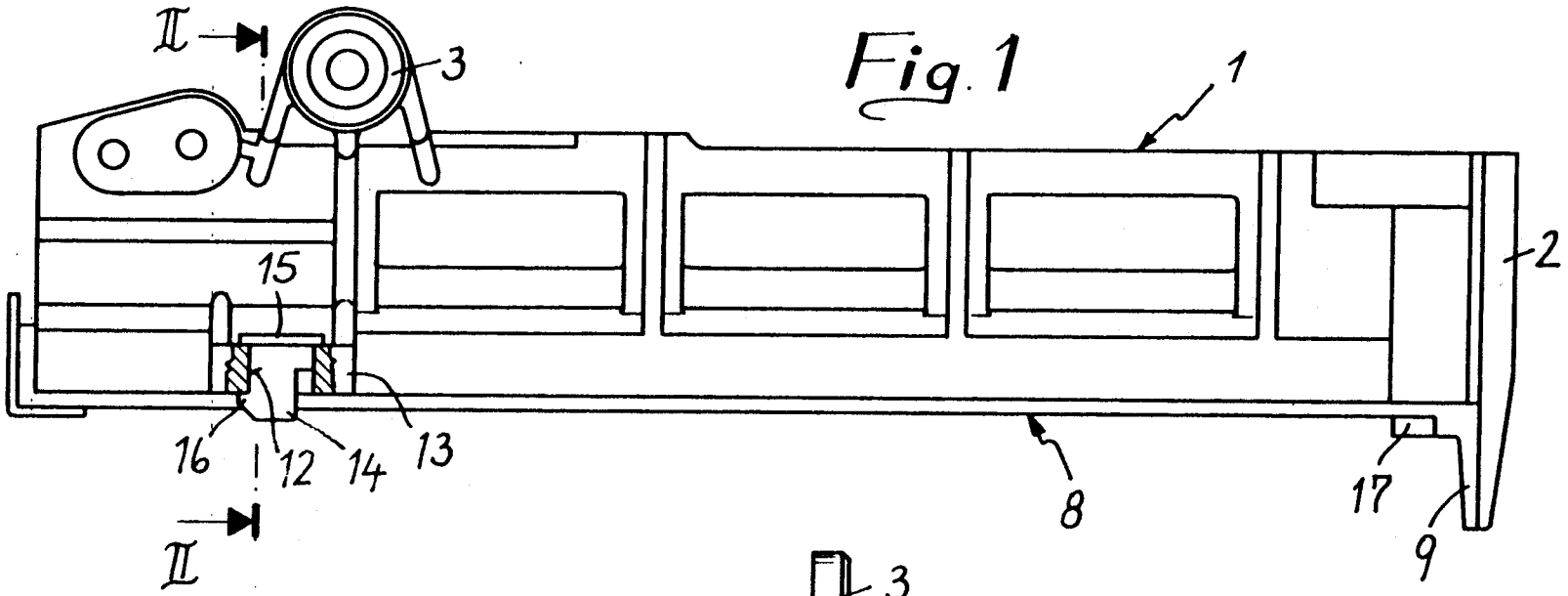
FIG. 1 is a side view of the cartridge in closed condition.
Figure 2:
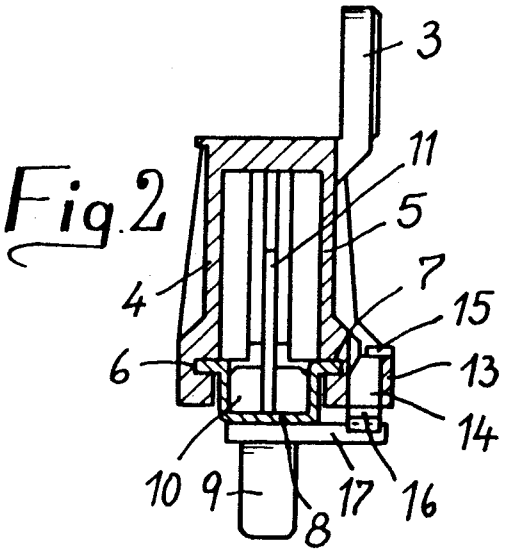
FIG. 2 is a cross sectional view taken along line II—II of FIG. 1.

With reference to said figures, the cartridge comprises an elongated body 1 which ends, at one end, with an expulsion or firing channel 2 and, on the opposite side, has a coupling 3 for connection to the handgrip of the riveting gun.

The cross section of the body 1 is in the shape of an inverted U, and an accommodation and guiding channel is defined therein for a strip of fastener elements.

The lower edges of the two parts 4, 5 which laterally delimit the accommodation channel, internally define each a respective longitudinal groove 6, 7 facing each other. A U-shaped lid 8 downwardly closes the body 1 and has two outwardly folded edges so as to slidably engage in the grooves 6, 7.

The lid 8 is rigidly associated at one end with a beak 9 which closes the end portion of the expulsion channel when the lid is completely inserted in the recesses 6, 7. Retention means, not illustrated, keep the beak 9 in closure position adjacent to the expulsion channel 2.

A conventional slider 10, provided with a staple pusher 11, moves within the accommodation channel and is pushed by elastic means.

The described cartridge is completed by a seat 12 defined externally to the part 5 by an eyelet 13 rigidly associated with the body 1 proximate to the end opposite to the expulsion channel 2.

The seat 12 is rectangular, and an elastic body 14 made of rubber or the like is inserted therein with a slight pressure. Said elastic body has a flange 15 resting on the eyelet 13 and a tooth 16 which ensures the retention of the elastic body by engaging the lower edge of the eyelet 13.

As can be seen in the figures, a protrusion 17 is rigidly associated with the lid 8 at a region near the beak 9, and such protrusion protrudes below the lid 8. The elastic body 14 also protrudes downwards from the eyelet 13 and from the lid 8.

The protrusion 17 additionally extends laterally from the lid, so that when said lid is caused to slide backwards to free the accommodation channel of the fastener elements and allow the insertion of a new strip of fastener elements, said protrusion 17 abuts against the elastic body 14, the elastic nature whereof dampens the impact.

The invention thus achieves the intended aim and objects.

The fact that the elastic body 14 can be extracted from its seat to be replaced in case of damage is particularly advantageous.

In the practical execution, the shapes and dimensions may vary as desired and according to the requirements.

I claim:

1. A cartridge for a riveting gun comprising an elongated body in the shape of an inverted U which forms an accommodating and guiding channel for the fastener elements and a slidable lid closing said accommodating and guiding channel, said lid having a beak defining an expulsion channel for the fastening elements, wherein proximate to an end of the elongated body which is opposite to the expulsion channel a lateral seat is formed for retaining an elastic body defining an abutment, said lid having a protrusion arranged proximate to said beak, both said elastic body and said protrusion protruding with respect to said lid such that said protrusion engages with said elastic body upon a backward rearward sliding motion of said lid with respect to said accommodating and guiding channel.

2. A cartridge according to claim 1, wherein said lateral seat is defined by an eyelet formed on an outer portion of the elongated body and said elastic body has a flange resting on the eyelet and a retention tooth.

3. A cartridge for a riveting gun comprising an elongated body means which forms a fastener element accommodating and guiding channel means and a slidable lid means adapted for closing said accommodating and guiding channel means, a fastener element expulsion channel means being provided at an end of said elongated body means and a seat means being provided at an other end of said elongated body, said slidable lid means having a first end arrangeable near said expulsion channel means which is provided with a protrusion means, an elastic body abutment means being accommodated in said seat means, both said protrusion means and said elastic body means protruding from said slidable lid means such that at least a portion of said protrusion means engages in dampening impact with at least a portion of said elastic body means upon a backward sliding motion of said slidable lid means with respect to said fastener element accommodating and guiding channel means.

* * * * *